US007444234B2

(12) United States Patent
Bauerle

(10) Patent No.: US 7,444,234 B2
(45) Date of Patent: Oct. 28, 2008

(54) METHOD AND APPARATUS FOR MONITORING AN INTAKE AIR FILTER

(75) Inventor: Paul A. Bauerle, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/669,368

(22) Filed: Jan. 31, 2007

(65) Prior Publication Data

US 2008/0183366 A1 Jul. 31, 2008

(51) Int. Cl.
*G06G 7/70* (2006.01)
*F02D 11/10* (2006.01)

(52) U.S. Cl. ..... 701/114; 123/361; 123/399

(58) Field of Classification Search ..... 701/114, 701/101, 102, 103, 110, 115; 123/336, 361, 123/396, 399; 73/117.3, 118
See application file for complete search history.

(56) References Cited

U.S. PATENT DOCUMENTS 4,497,301 A * 2/1985 Inoue et al. ..... 123/486
4,926,335 A 5/1990 Flowers et al.
5,585,553 A 12/1996 Schricker
5,606,311 A 2/1997 Polidan et al.
5,758,621 A * 6/1998 Suzuki et al. ..... 123/399
6,427,527 B1 8/2002 Langer
6,695,895 B2 * 2/2004 Hyodo et al. ..... 96/111
6,915,782 B2 * 7/2005 Hanada et al. ..... 123/399
6,957,140 B1 10/2005 Bauerle et al.
7,103,468 B2 * 9/2006 Wakashiro et al. ..... 701/110
7,111,611 B1 * 9/2006 Lyon ..... 123/399

OTHER PUBLICATIONS

Anonymous; Learning the Maximum Throttle Sensor Positions on ETC Vehicles; Sep. 2006; Publ. No. 509059; Research Disclosure; www.researchdisclosure.com; New York, NY, USA.

* cited by examiner

*Primary Examiner*—Willis R. Wolfe, Jr.
*Assistant Examiner*—Johnny H. Hoang

(57) ABSTRACT

There is provided a method and system for monitoring an intake air filter for an internal combustion engine of a hybrid powertrain operative to transmit an output torque to a driveline. The engine has a controllable throttle valve. The method comprises determining a first pressure state comprising an ambient barometric pressure. A second pressure state is determined downstream of the air filter during engine operation at a high flow engine operating point. The hybrid powertrain is controlled to maintain the transmitted output torque to the driveline. The first and second pressure states are compared.

16 Claims, 3 Drawing Sheets

METHOD AND APPARATUS FOR MONITORING AN INTAKE AIR FILTER

TECHNICAL FIELD

This invention relates to internal combustion engines, and more particularly, to a method and apparatus for monitoring an intake air filter for an engine that is an element of a hybrid powertrain system.

BACKGROUND OF THE INVENTION

The statements in this section merely provide background information related to the present disclosure and may not constitute prior art.

Internal combustion engines have air intake systems which use air filtering devices to prevent ingestion of harmful particles into the engine and combustion chambers. The service life of an element for an air filter varies depending upon operating environment of the engine. For example, a vehicle used in a primarily dusty environment requires more frequent service to and/or replacement of the air filter element than a vehicle used in a clean environment. Delay in servicing an air filter element can result in increased engine pumping losses, which can lead to reduced fuel economy. Vehicle driveability performance can also deteriorate.

A filter element that is unduly plugged can become an airflow restriction, meaning that there is a discernible pressure drop across the air filter. When airflow through the filter element increases, such as at high engine speed and load conditions, the pressure drop increases, which results in the aforementioned increase in pumping losses.

Prior art systems to monitor air filter element plugging have used pressure drop measurements or other indicators to determine when to service and replace the filter element. Some prior art systems have incorporated a barometric pressure sensor upstream of the air filter element which can be used to monitor pressure drop through the air intake system, including a pressure drop across the filter element. Other systems have incorporated control algorithms to determine pressure after the filter and upstream of a throttle valve, in order to determine barometric pressure, which can also be used to monitor pressure drop across the filter element.

Barometric pressure varies with weather conditions and altitude. In a motor vehicle, an accurate determination of barometric pressure is essential for various engine control functions. For instance, precise metering of the amount of air and fuel delivered to the engine is necessary to achieve the desired combustion as well as acceptable vehicle emissions. When the barometric pressure drops, typically ignition timing must be retarded and the air/fuel mixture richened. In addition, the barometric pressure may also be used to control idle bypass airflow, check for limp-in conditions and perform diagnostic functions.

Barometric pressure can be measured in a variety of ways. Currently, in automotive applications, the barometric pressure can be measured using a barometric pressure sensor mountable on any suitable place on the vehicle where it sees true atmospheric pressure. Such a sensor generates an output signal indicative of the atmospheric pressure. The barometric pressure reading is then used for the various engine control functions. However, barometric pressure sensors can be costly and it is always desirable, particularly in automotive applications, to minimize costs.

Methods have been developed for estimating barometric pressure without the use of a separate or dedicated barometric pressure sensor. It is known, for example, that barometric pressure can be estimated when the vehicle's throttle is wide open (i.e., WOT) and, in some cases, when the vehicle's throttle is at some part throttle positions using an existing manifold absolute pressure sensor. However, there is typically a lower throttle position threshold below which barometric pressure cannot be estimated reliably when the engine is firing or rotating.

On a vehicle equipped with a hybrid powertrain, i.e., an internal combustion engine coupled to an electro-mechanical or hydro-mechanical transmission, the engine typically employs an electronic throttle control system, which decouples operator throttle pedal input from throttle valve control. Engine operation on a hybrid powertrain may include prolonged operation at or below the lower throttle position threshold for estimating barometric pressure, and fewer opportunities for WOT events, thereby resulting in unreliable barometric pressure estimates. The result of such operation is barometric pressure values are infrequently updated and thus become 'stale' and unreliable for monitoring the air filter element.

Thus, it is desirable to have a reliable method for monitoring an intake air system including the air filter in a hybrid vehicle.

SUMMARY OF THE INVENTION

In accordance with an embodiment of the invention, there is provided a method and system for monitoring an intake air filter for an internal combustion engine of a hybrid powertrain operative to transmit an output torque to a driveline. The engine has a system-controllable throttle valve. The method comprises determining a first pressure state comprising an ambient barometric pressure. A second pressure state is determined downstream of the air filter during engine operation at a high mass airflow engine operating point. The hybrid powertrain is controlled to maintain the transmitted output torque to the driveline. The first and second pressure states are compared.

These and other aspects of the invention will become apparent to those skilled in the art upon reading and understanding the following detailed description of the embodiments.

DESCRIPTION OF THE DRAWINGS

The invention may take physical form in certain parts and arrangement of parts, the embodiments of which are described in detail and illustrated in the accompanying drawings which form a part hereof, and wherein.

DESCRIPTION OF EXEMPLARY EMBODIMENTS

Figure 1:
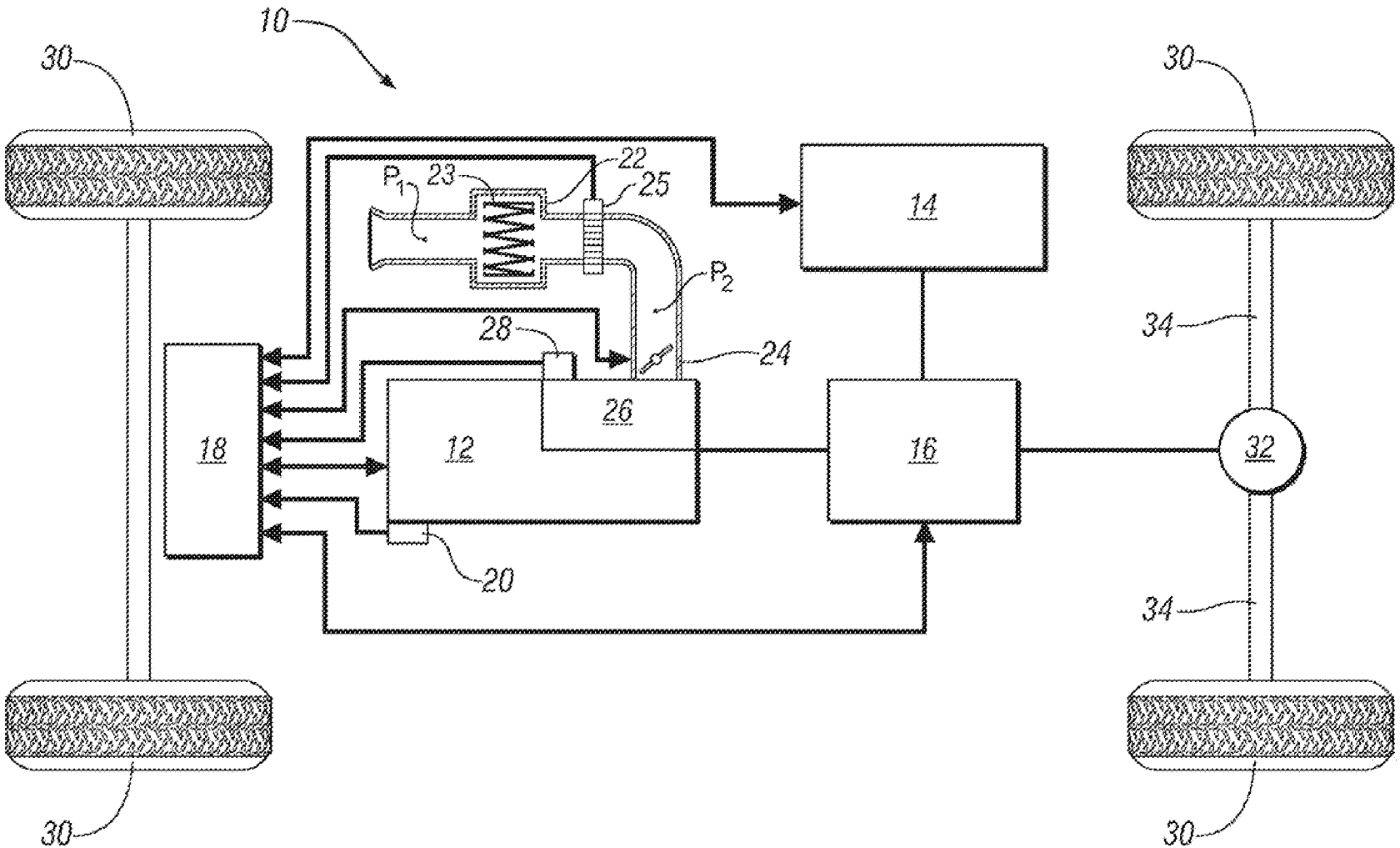
FIG. 1 comprises a schematic diagram, in accordance with the present invention, and, FIGS. 2A and 2B comprise algorithmic flowcharts, in accordance with the present invention.

Referring now to the drawings, wherein the depictions are for the purpose of illustrating the invention only and not for the purpose of limiting the same, FIG. 1 depicts a schematic drawing of a hybrid electric vehicle 10. The hybrid electric vehicle 10 includes an internal combustion engine 12, an electrical power source 14, an electrical machine 16, and at least one control module 18. The hybrid electric vehicle 10 may have any suitable drive train configuration, such as a series hybrid drive, a parallel hybrid drive, or a split hybrid drive as is known by those skilled in the art. The internal combustion engine 12 comprises a multi-cylinder engine having a rotating crankshaft, the rotations of which are sensed by a speed sensor 20. Speed sensor 20 may be any appropriate sensor of the type adapted to generate a signal indicative of the rotational speed of the crankshaft. An example of such a sensor is a magnetic pickup adjacent to a toothed flywheel (not shown) of the engine 12 coupled to a counter that counts pulses for unit time and supplies such counts on a regular basis.

The engine 12 as depicted comprises a naturally-aspirated air intake system wherein the intake air flows from the atmosphere at barometric pressure to an air inlet and through an air filter device 22 comprising a case and an air filter element 23. An outlet of the air filter device leads to ductwork that includes a mass air flow (MAF) sensor 25 and leads to a system-controllable intake-air flow management device, in this embodiment comprising an electronic throttle control (ETC) device 24 including a throttle plate which is controlled by the control module 18. The ETC device 24 is controlled by the control module 18 to regulate flow of air into an intake manifold 26 for distribution to the cylinders of the engine. Associated with the intake manifold 26 is a pressure sensor 28 for measuring manifold absolute pressure (MAP). MAP sensor 28 generates a signal indicative of the absolute pressure within the intake manifold 26 downstream of the throttle plate. Engine operation is generally characterized in terms of the engine speed and load or mass airflow, referred to as an engine operating point, which can range from a low speed, low load condition to a high-speed, high load condition.

The electrical power source 14 may be of any suitable type. For example, an electrical power source 14 such as a battery, a battery pack having a plurality of electrically interconnected cells, a capacitor, or a fuel cell may be employed. Alternatively, a non-electrical power source, such as a hydraulic power source can be employed. For simplicity, the description below will primarily refer to an embodiment of the present invention that incorporates an electrical power source.

The electrical machine 16 may be of any suitable type, such as an electric motor or motor-generator, an electro-mechanical transmission device having a motor or a motor-generator, or, a starter-alternator. As depicted in FIG. 1, the electrical machine 16 is connected to the engine 12 and the power source 14. More specifically, the electrical machine 16 may be powered by the power source 14 and may be adapted to drive the engine 12 or one or more vehicle traction wheels 30. In addition, power may flow through the electrical machine 16 in the opposite direction to charge the power source or drive the engine 12. In the embodiment shown in FIG. 1, the electrical machine 16 is connected to a driveline comprising a differential 32 connected to a pair of axles or transaxles 34 each connected to a vehicle traction wheel 30.

The control module 18 monitors operator inputs, including an operator torque request ($T_{O_RQ}$) typically input through an accelerator pedal, and controls various aspects of the hybrid electric vehicle 10 to meet the operator torque request and achieve other functions. For example, the control module 18 may be connected to the engine 12, the power source 14, and electrical machine 16 to monitor and control their operation and performance. In addition, the control module 18 also processes inputs from the various sensors for controlling the engine 12 and electrical machine 16.

The control module 18 is preferably a general-purpose digital computer generally comprising a microprocessor or central processing unit, storage mediums comprising read only memory (ROM), random access memory (RAM), electrically programmable read only memory (EPROM), i.e., non-volatile memory, high speed clock, analog to digital (A/D) and digital to analog (D/A) circuitry, and input/output circuitry and devices (I/O) and appropriate signal conditioning and buffer circuitry. The control module has a set of control algorithms, comprising resident program instructions and calibrations stored in ROM and executed to provide the respective functions thereof. Information transfer between the control module and any other on-vehicle computers can be accomplished using some form of controller area network (CAN).

Algorithms are typically executed during preset loop cycles such that each algorithm is executed at least once each loop cycle. Algorithms stored in the non-volatile memory devices are executed by the central processing unit and are operable to monitor inputs from the sensing devices and execute control and diagnostic routines to control operation using preset calibrations. Loop cycles are typically executed at regular intervals, for example each 3.125, 6.25, 12.5, 25, 100, and 1000 milliseconds during ongoing engine and vehicle operation. Alternatively, algorithms may be executed in response to occurrence of an event.

Figure 2A:
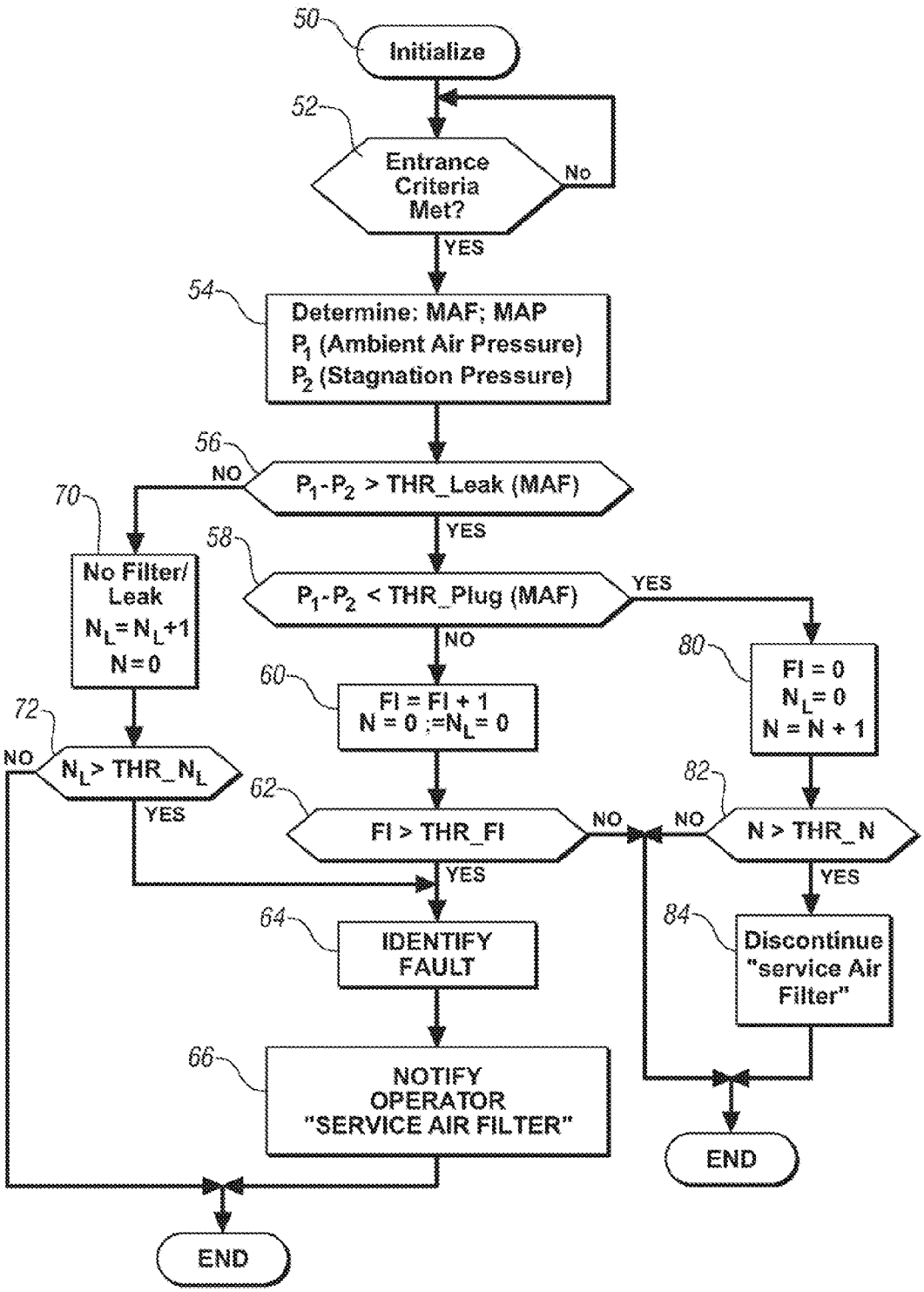
Figure 2B:
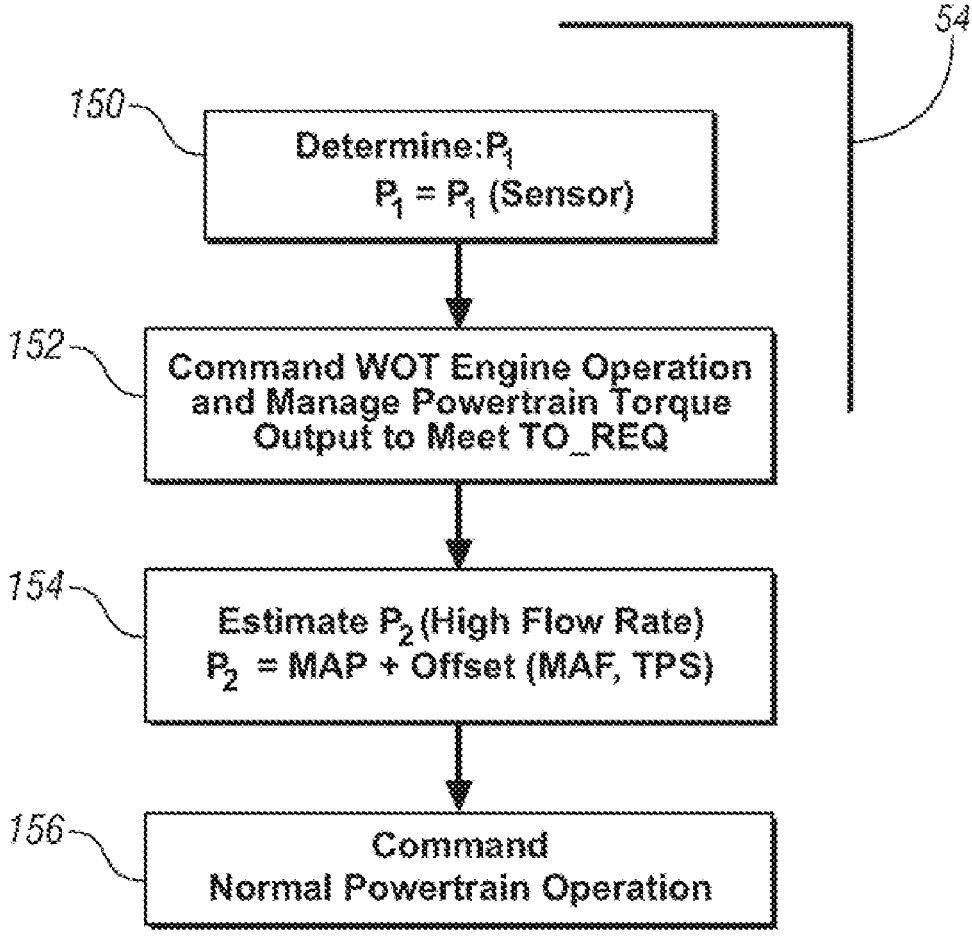

Referring now to FIGS. 2A and 2B, flowcharts are provided to further describe aspects of the invention. The flowcharts depict details of algorithms and calibrations which have been reduced to machine code for execution in the control module 18. At start of vehicle operation, the system is initialized (Step 50), which includes verifying a need to execute the code. After the initialization, it is determined whether entrance criteria have been met (Step 52), including identifying presence of faults in any sensors or actuators, and determining presence of acceptable operating conditions. States of parameters comprising MAF, MAP, ambient barometric pressure P1, and stagnation pressure P2 are determined (Step 54). It is preferred to measure pressure drop across the air filter element (i.e., P1−P2) under conditions which are most favorable to measure and discern air flow restrictions resulting from plugging, i.e., at higher engine airflows which occur at higher engine speed and load conditions. A difference between the ambient pressure P1 and stagnation pressure P2 is determined, and compared to a leak threshold difference in pressure which has been precalibrated based upon mass airflow (i.e., Thr_Leak(MAF)) to determine presence of leaks in the intake system (Step 56). The leak test algorithm is aborted if a leak is so detected, a leak fault indicator ($N_L$) is incremented, and a test pass counter (N) is reset to zero (Step 70). When the leak fault indicator ($N_L$) exceeds a predetermined threshold, Thr_$N_L$ (Step 72), a 'NO FILTER/LEAK' result is reported as an identified fault to the control module (Step 64), and the operator is notified to service the air filter (Step 66).

When no leak is detected in Step 56, the difference between the ambient pressure P1 and stagnation pressure P2 is then compared to a plugged filter threshold pressure difference which has been precalibrated based upon mass airflow (i.e., Thr_Plug(MAF)) to determine if the pressure drop across the air filter indicates a plugged filter (Step 58). When the difference between the ambient pressure P1 and stagnation pressure P2 is less than the plugged filter threshold, i.e., P1−P2<Thr_Plug(MAF));

it is determined that the filter is functioning properly. The leak fault indicator ($N_L$) and fault indicator (FI) are reset to zero, and the test pass counter (N) is incremented (Step 80). When the test pass counter exceeds a predetermined threshold, Thr_N (Step 82), any previously set notification to the vehicle operator to service the air filter (e.g., a "Service Air Filter" light) is discontinued (Step 84). Otherwise the air filter monitoring routine ends for the trip.

When the difference between the ambient pressure P1 and stagnation pressure P2 is greater than the plugged filter threshold, i.e., P1−P2>Thr_Plug(MAF)), the fault indicator (FI) is incremented and the test pass counter (N) and the leak fault indicator ($N_L$) are reset to zero (Step 60), indicating that there is a fault, i.e., some form of airflow restriction in the intake system during the trip. When the fault indicator (FI) exceeds a fault indicator threshold (Step 62), a fault is identified (Step 64) and the vehicle operator is notified (Step 66), preferably with some form of "Service Air Filter" light on the vehicle dashboard. Preferably, the algorithm described is executed once per vehicle trip, or once per engine on-off operating cycle.

The plugged filter threshold (Thr_Plug(MAF)) comprises an array of calibrated thresholds which are predetermined for a range of engine airflow (MAF) levels, and preferably developed using a representative engine with a production-intent air intake system utilizing plugged air filter elements or other simulated airflow restriction devices.

Steps 60-66 comprise a method of verifying presence of a fault through iterative testing and notifying the vehicle operator. The fault threshold FI_Thr can comprise occurrence of a quantity of consecutive faults, or, alternatively, X quantity of faults occurring over Y consecutive test iterations, or other suitable fault detection scheme.

The entrance criteria of Step 52 include identifying presence of faults in any sensors or actuators, and determining presence of acceptable operating conditions. The faults of interest include faults associated with the ETC device 24, the MAF sensor 25, the MAP sensor 28, and the engine speed sensor 20, and any ambient air pressure sensors mechanized in the system, such as to monitor P1 and P2. Faults of interest include those associated with an electric power supply and wiring harnesses between the devices and the control module. ETC device faults comprise faults in sensors which measure throttle valve position, a fault with the throttle motor control such that the ETC device 24 cannot be controlled, or a detection of too high an airflow compared to what the airflow estimated from the throttle position is expected to be, or too low an airflow compared with what the airflow from the throttle position is expected to be. The MAF sensor output is compared to determine that it is operating in a standard range, and is consistent with estimated airflow readings. The MAP sensor 28 is checked to determine that it is operating in a standard range, i.e. below an upper limit and above a lower limit. Also engine speed faults may be present if the engine speed sensor 20 is missing or erratic.

Referring now to FIG. 2B, determining the barometric pressure P1 and the stagnation pressure P2 (Step 54) is now described in detail. The barometric pressure P1 is a measure of ambient pressure, which is subject to variation based upon vehicle elevation, and atmospheric conditions. The barometric pressure P1 is determined (Step 150) which include directly measuring the barometric pressure using an appropriately located sensing device or measuring/estimating the barometric pressure using information from a sensor which serves other functions. The barometric pressure P1 is regularly and periodically updated or refreshed, either after a predetermined time lapse or, preferably, after the vehicle has traveled a predetermined distance in order to ensure the barometric pressure accurately reflects the ambient conditions.

The barometric pressure P1 for a hybrid vehicle can be determined during periods of vehicle operation in which the engine 12 is not firing and not rotating. This can occur during a vehicle stop condition when the engine has been shut off, or during operating conditions when vehicle tractive torque is provided exclusively by the electrical machine 16 to drive the vehicle 10 and the engine has been shut off. When the engine 12 is not rotating, system air pressure equilibrates as the intake manifold 26 fills with atmospheric air and, thus, the barometric pressure can be estimated to equal the pressure measured by the MAP sensor 28 since there is little or no air flow. Preferably, this estimate is taken after a precalibrated amount of time has elapsed since the engine stopped rotating in order to allow the intake manifold 26 sufficient time to equilibrate pressure with the atmospheric air, for example, five (5) seconds.

The barometric pressure P1 can be estimated during a low flow operating condition, e.g., a part-throttle operation at low engine speed. Estimating the barometric pressure P1 at part-throttle operation at low engine speed involves a predetermined calibration table or equation based upon manifold pressure (MAP), engine speed (RPM), throttle position (TPS), and/or airflow (MAF). The predetermined calibration preferably comprises a plurality of pressure offsets (Offset (MAF, TPS) determined over ranges of airflows and throttle positions. The pressure offset is added to the MAP state to estimate barometric pressure P1. The pressure offset calibration is developed using a representative engine with a production-intent air intake system utilizing a clean air filter element. One method to estimate barometric pressure using a pressure offset calibration is described in commonly assigned co-pending U.S. patent application Ser. No. 11/464,314, entitled "Method and System for Estimating Barometric Pressure in a Hybrid Vehicle", which is incorporated herein by reference.

The stagnation pressure P2 is determined (Steps 152 and 154). The stagnation pressure P2 comprises a pressure state in the intake air ductwork upstream of the throttle blade of the ETC device 24. Stagnation pressure is preferably determined at high engine operating points which occur at high engine speed and load conditions, e.g., at or near WOT conditions. Estimating the stagnation pressure P2 at wide-open-throttle also requires the aforementioned predetermined calibration table or equation based upon manifold pressure (MAP), engine speed (RPM), throttle position, and/or airflow (MAF). The predetermined calibration preferably comprises the offset pressure value (Offset(MAP, TPS) which is added to the MAP pressure to estimate the stagnation pressure P2. On a system employing an intake air pump device such as a turbocharger in the air intake system (not shown), the stagnation pressure P2 is defined to be pressure in the air duct after the air cleaner element and upstream of an air inlet to the turbocharger, and can be measured directly using a pressure sensing device.

The stagnation pressure P2 is preferably determined under conditions of high airflow as previously described, measured within a predetermined elapsed distance from when the barometric pressure P1 is measured. To determine the stagnation pressure P2 within the predetermined elapsed distance from when the barometric pressure P1 is measured, the control module executes a control scheme to intrusively command the engine to a wide open throttle condition. Concurrently and in corresponding magnitude, the control module executes algorithms to manage overall powertrain torque output to meet the operator torque request ($T_{O_REQ}$), to accommodate the increased engine torque output resulting from engine operation at or near WOT (Step 152). This comprises the control module executing torque control schemes to manage the increased engine torque by correspondingly increasing torque absorbed through the electrical machine 16 in form of electrical energy generation and charging of electrical power source 14, by decreasing torque output by the electrical machine 16 to the driveline, or some combination thereof. In so doing, torque output to the driveline is substantially unchanged, and therefore no torque surge is perceived by the operator. When the engine operating state at or near WOT is achieved, P2 at the high mass air flowrate can be estimated as above (Step 154). When stagnation pressure P2 has been estimated or measured, normal powertrain operation is commanded (Step 156), and the torque control and management schemes are phased out and discontinued as the throttle is controlled to normal operation.

The leak test (Step 56) is based upon there being some airflow-based pressure drop in a properly assembled air intake system having a substantially clean filter element. On a system configuration that contains no leaks, there is a pressure drop between the ambient pressure P1 and the stagnation pressure P2 measured at WOT operation. If a leak is introduced due to a misassembly of a system or a hole in the ductwork, or if the filter element is missing, the pressure drop between the ambient pressure P1 and the stagnation pressure P2 (preferably determined at WOT operation) is perceptibly less. The leak threshold (Thr_Leak(MAF)) can be determined and calibrated during pre-production testing of a representative system based upon MAF. Alternatively, the leak test can comprise a separate and distinct test wherein a pressure drop is determined between the ambient pressure P1 and the stagnation pressure P2 determined at a low engine flow operation. The pressure drop between the ambient pressure P1 and the stagnation pressure P2 measured at low or closed throttle operation is perceptibly less in presence of a leak or a missing filter element, and the leak threshold (Thr_Leak(MAF)) can be determined and calibrated during pre-production testing of a representative system. The leak test described herein is primarily intended to identify leaks and misassemblies occurring in the air cleaner and ductwork leading to the MAF sensor 25. A second algorithm, e.g., an intake air flow rationality algorithm, uses engine speed/load measurements and signals from the MAF sensor 25 to identify presence of leaks between the MAF sensor and the engine.

On a typical ETC system, a calibration for TPS v. MAF is a fixed relationship. When the ETC is controlled to WOT, i.e., 100% TPS, a result can include a dead throttle blade travel position at WOT or a non-linear torque response if the true maximum throttle opening occurs before 100% indicated throttle position. There is potentially a loss of engine torque capacity if the true WOT throttle position varies from the throttle position indicated by 100% TPS.

Indicated throttle position (TPS) is determined as follows in Eq. 1:

$$TPS = \frac{(\text{TPS_meas} - \text{TPS_min})}{(\text{TPS_max} - \text{TPS_min})} * 100\% \quad [1]$$

wherein:

TPS_meas comprises the currently measured TPS reading;

TPS_min comprises the TPS reading at minimum airflow; and,

TPS_max comprises the TPS reading at maximum airflow.

Under conditions described hereinabove wherein the control module commands the ETC to a wide-open throttle position, the control module selectively executes algorithms to control the ETC to increase the throttle opening in a step-wise manner. Increasing the throttle opening in a step-wise manner comprises controlling the throttle to monotonically increase opening in discrete steps, typically measured by discrete TPS readings, e.g., 75%, 80%, 85%, etc., up to the ETC throttle blade reaching a maximum position or stop, as indicated by electrical current required to control the ETC. Readings are taken from the MAF sensor, and the TPS is determined at each of the steps, to determine mass air flow and corresponding throttle position. The mass air flow and throttle position results are evaluated to identify a maximum mass air flow and corresponding TPS reading. The TPS reading at which the maximum mass air flow occurs becomes the maximum TPS reading, i.e., TPS_max, for future control purposes, and is stored in one of the non-volatile memory devices. In one implementation, the control module monitors airflow as the throttle position is increased. When the mechanical stop is encountered or the airflow starts to decrease (meaning the throttle blade is already past a maximum airflow), then the control algorithm begins to decrease the throttle slowly (limited to a calibration) until the airflow reaches maximum. The algorithm can be enabled periodically, e.g., once every 10 key cycles or so, or after loss of the TPS_max position due to memory corruption. There are enable criteria to ensure the learning only occurs when there are no errors in the sensors being learned or used, including e.g., MAF sensor errors. There can also be a rate limitation to ensure the TPS_max position changes by less than a calibratable amount to provide stability.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. Method for monitoring an intake air filter for an internal combustion engine of a hybrid powertrain operative to transmit an output torque to a driveline, the engine having a system-controllable throttle valve, comprising:

determining a first pressure state comprising an ambient barometric pressure;

determining a second pressure state downstream of the air filter during engine operation at a high mass airflow engine operating point and while controlling the hybrid powertrain to maintain the transmitted output torque to the driveline to meet an operator torque request; and, comparing the first and second pressure states.

2. The method of claim 1, comprising identifying a fault of the intake air filter when a difference between the first and second pressure states is greater than a threshold.

3. The method of claim 2, wherein the threshold is determined based upon the mass airflow.

4. The method of claim 1, further comprising determining the second pressure state within an elapsed distance from the first pressure state.

5. The method as recited in claim 1, wherein controlling the hybrid powertrain to maintain the transmitted output torque to the driveline to meet an operator torque request further comprises adjusting torque output from an electrical machine of the hybrid powertrain to counter an increase in engine torque resulting from operating the engine at the wide open throttle condition.

6. The method of claim 5, wherein adjusting torque output from the electrical machine of the hybrid powertrain comprises increasing electrical energy charging to a battery.

7. The method of claim 5, wherein adjusting torque output from the electrical machine of the hybrid powertrain comprises decreasing torque output from the electrical machine to the driveline.

8. The method of claim 1, wherein determining the first pressure state comprises directly measuring the ambient barometric pressure with a sensor.

9. The method of claim 1, wherein determining the first pressure state comprises determining the first pressure state based upon manifold absolute pressure measured during a period when the engine is not rotating.

10. The method of claim 1, wherein determining the first pressure state comprises determining a manifold absolute pressure during engine operation at a low mass airflow, and, estimating the first pressure state based upon the manifold absolute pressure and the engine airflow.

11. Article of manufacture, comprising a storage medium containing a machine-executable program operative to monitor an intake air filter system for an internal combustion engine of a hybrid powertrain operative to transmit an output torque to a driveline, the engine having a system-controllable throttle valve, the program comprising:

code to determine a first pressure state comprising an ambient barometric pressure;

code to determine a second pressure state downstream of the air filter during engine operation at a high flow engine operating point and while controlling the hybrid powertrain to maintain the transmitted output torque to the driveline to meet an operator torque request; and, code to compare the first and second pressure states.

12. The article of claim 11, wherein the code to determine the second pressure state downstream of the air filter comprises code to determine the pressure state immediately upstream of the throttle valve.

13. The article of claim 11, wherein the code to determine the second pressure state downstream of the air filter comprises code to determine the pressure state upstream of an inlet from a turbocharger device.

14. Method for monitoring an intake air filter for an internal combustion engine of a hybrid powertrain operative to transmit an output torque to a driveline, the engine having a system-controllable throttle valve, comprising:

determining a first pressure state comprising an ambient barometric pressure;

determining a second pressure state downstream of the air filter during engine operation at a high mass airflow engine operating point and controlling the hybrid powertrain to maintain the transmitted output torque to the driveline, wherein determining the second pressure state during engine operation at the high mass airflow engine operating point further comprises:

controlling the engine to operate at a substantially wide open throttle condition; and, determining the second pressure state downstream of the air filter during the engine operation at the substantially wide open throttle condition; and, comparing the first and second pressure states.

15. The method of claim 14, wherein determining the second pressure state downstream of the air filter comprises directly measuring the pressure downstream of the air filter during the engine operation at the substantially wide open throttle condition.

16. The method of claim 14, wherein determining the second pressure state downstream of the air filter during the engine operation at the substantially wide open throttle condition comprises:

determining engine mass airflow and an intake manifold pressure;

determining a pressure offset based on the engine mass airflow; and estimating the second pressure state upstream of the throttle valve based on the pressure offset and the intake manifold pressure.

* * * * *